United States Patent [19]

Codd

[11] 4,438,616

[45] Mar. 27, 1984

[54] SPACE FRAMES

[76] Inventor: Edwin T. Codd, 87 Albert St., Brisbane, Queensland, 4000, Australia

[21] Appl. No.: 354,081

[22] PCT Filed: Jul. 13, 1981

[86] PCT No.: PCT/AU81/00089

§ 371 Date: Feb. 1, 1982

§ 102(e) Date: Feb. 1, 1982

[87] PCT Pub. No.: WO82/00311

PCT Pub. Date: Feb. 4, 1982

[30] Foreign Application Priority Data

Jul. 11, 1980 [AU] Australia ..... PE4480

[51] Int. Cl.[3] ..... E04H 12/00

[52] U.S. Cl. ..... 52/650; 52/655; 403/172

[58] Field of Search ..... 52/655, 648, 80, 81, 52/650, 654; 403/171, 172, 176, 169

[56] References Cited

U.S. PATENT DOCUMENTS

| | | | |
|---|---|---|---|
| 2,284,898 | 6/1942 | Hartman . | |
| 3,120,955 | 2/1964 | Carlin . | |
| 3,336,718 | 8/1967 | Cape | 52/650 |
| 3,443,348 | 5/1969 | Papayoti | 52/648 |
| 3,477,189 | 11/1969 | Merson | 52/648 |

*Primary Examiner*—Henry E. Raduazo

*Attorney, Agent, or Firm*—Schwartz, Jeffery, Schwaab, Mack, Blumenthal & Koch

[57] ABSTRACT

At each of the nodes (20) of a double-layer flat grid space frame, the longitudinal chord members (10,12) and the lateral chord members (11,13) of both the upper grid and the lower grid are in superimposed crossing arrangement, the ends (18) of the diagonal struts (14) which interconnect the nodes (20) of the upper and lower grids being interposed between longitudinal chord members (10,12) and lateral chord members (11,13), a connector member (19) being secured through the end (18) of each diagonal strut (14) extending from the node (20) and through the chord members above and below it.

4 Claims, 5 Drawing Figures

SPACE FRAMES

BACKGROUND OF THE INVENTION

1. Field of the Invention

This invention relates to space frames.

2. Brief Description of the Prior Art

Space frames are well known and extensively used in the construction of buildings such as exhibition halls, theatres and the like where large areas are required to be covered, free of supporting columns. For such purposes, architects commonly favour space frames of the double-layer flat grid type, such a structure having an upper square grid assembly of longitudinal and transverse chord members spaced above a lower square grid assembly of longitudinal and transverse chord members, intersections of the upper and lower grids being interconnected by diagonal struts so that the space frame consists of a combination of square-base pyramidal shapes.

The economy or otherwise of space frames of this type is particularly sensitive to the cost of the nodal connections of the members comprising the grid, and a variety of connector components have been devised for interconnecting, at each node of the structure, the longitudinal and lateral chord members and the diagonal struts.

An ideal jointing method should:

(a) permit any required arrangement and number of members at the joint,
(b) match the strength of the incoming members,
(c) be compact,
(d) employ readily available materials suited to mass production,
(e) be suitable for use with standard steel members,
(f) require little or no specialised technique or equipment in fabrication,
(g) be simple to assemble,
(h) be compatable with other building materials,
(i) be economical in the completed structure.

BRIEF SUMMARY OF THE INVENTION

The present invention has been devised with the general object of providing a space frame in which the node connections satisfy these requirements.

Accordingly, the invention resides broadly in a space frame of the type having an upper grid of longitudinal and lateral chord members, a lower grid of longitudinal and lateral chord members, and diagonal struts interconnecting nodes at chord intersections of the two grids, wherein at each node one chord member overlies the other, an end of each strut extending from the node is interposed between the said chord members, and a connector member is secured through each of the said strut ends and through the chord members above and below the said strut end.

DETAILED DESCRIPTION OF THE PREFERRED EMBODIMENT

Figure 1:
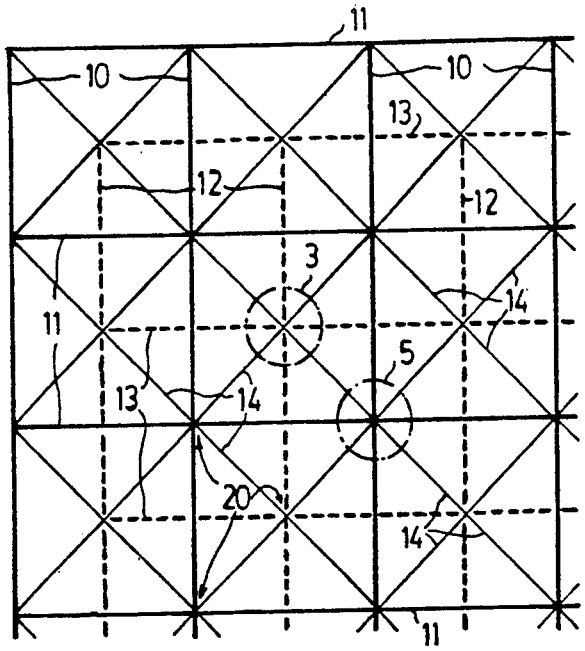
FIGS. 1 and 2 are diagrammatic plan and elevation views respectively of a section of a flat double-layer space frame.
Figure 2:
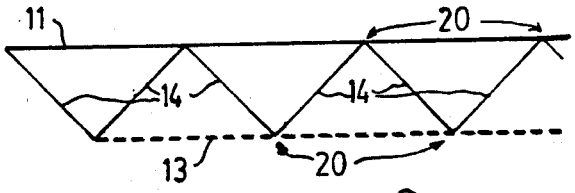

The double-layer flat grid space frame illustrated is built up of longitudinal chord members 10 and lateral chord members 11 interconnected to form an upper square grid; longitudinal chord members 12 and lateral chord members 13 interconnected to form a lower square grid; and web diagonals or struts 14 fixed between the upper and lower grids.

All of the chord members 10, 11, 12 and 13 are of fairly light gauge channel sections, their parallel flanges 15 having edge portions 16 turned through right angles towards each other, the channels of the longitudinal and lateral chord members of each of the upper and lower grids being oppositely directed so that the webs 17 of the crossing members are towards each other.

Figure 4:
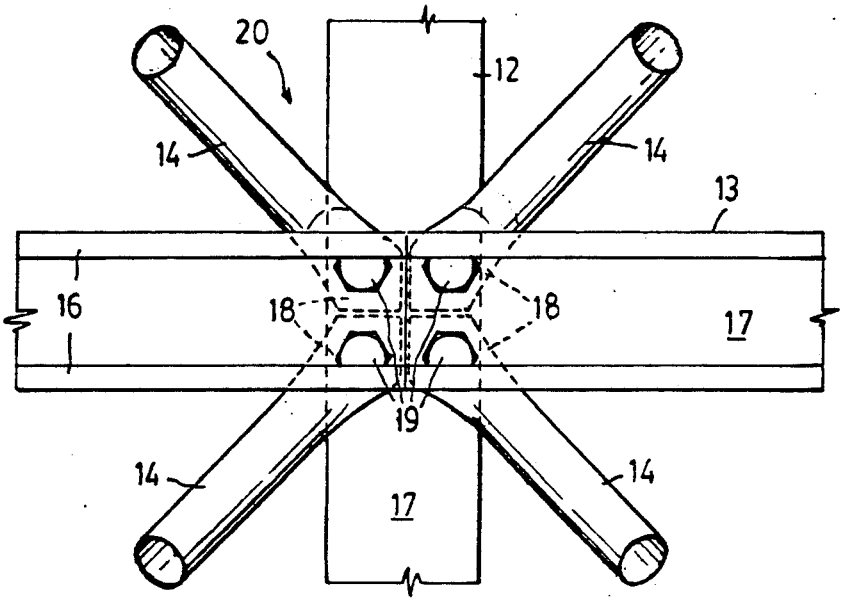
FIG. 4 is a plan view of the parts shown in FIG. 3.

Each of the diagonal struts 14 is of fairly light gauge steel tube, having both end portions flattened, as indicated at 18, the two flattened ends being bent, in opposite directions, through an acute angle to the axis of the main unflattened part of the strut, so that the two flattened end portions 18 are parallel. Both sides of each flattened end portion 18 are mitred, as shown in FIG. 4, to meet, at an extremity of the strut, at a right angle.

Figure 5:
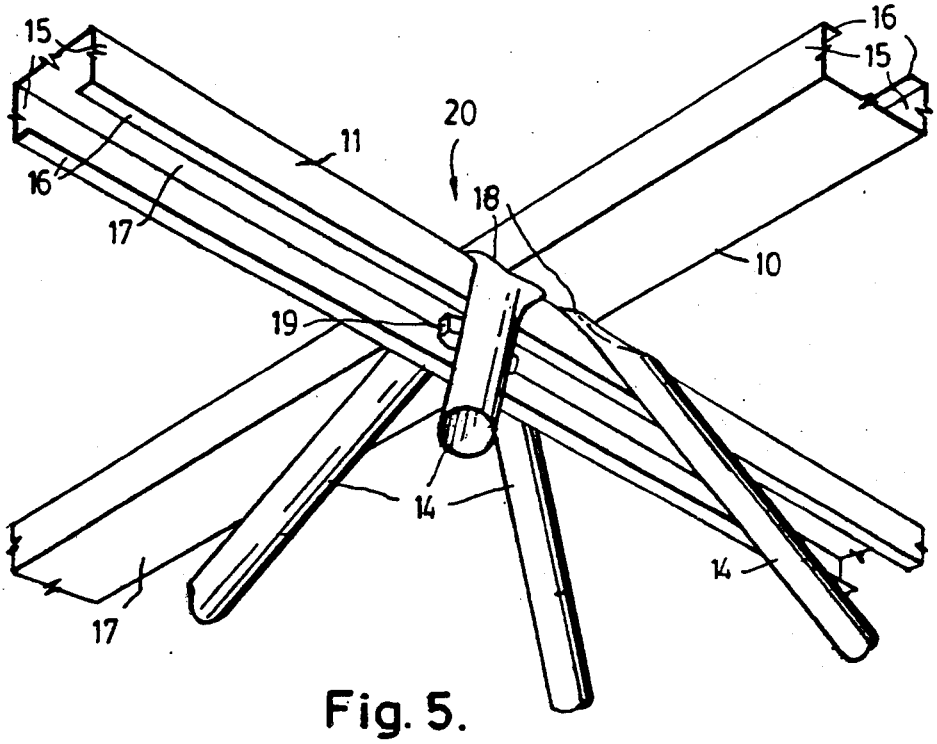
FIG. 5 is a perspective view of the parts of the space frame encircled at 5 in FIG. 1.

At each intersection in the upper grid of longitudinal and lateral chord members 10 and 11 (see FIG. 5) and at each lower grid intersection of longitudinal and lateral chord members 12 and 13 (see FIGS. 3 and 4), the two crossing members have the flattened ends 18 of four diagonal struts 14 interposed adjacently between them, four bolts 19 making a secure connection at the node 20. Each of the bolts 19 passes through registering bolt holes in the longitudinal chord member, one of the interposed strut flattened end, and the lateral chord member. As shown in FIG. 4, the abutting mitred edges of adjacent strut end portions assist in imparting rigidity to the nodal connection.

At each node 20 of the lower grid, at the periphery of the grid, the connection between these two members and four diagonal struts is made similarly with four bolts.

At each of the corners of the upper grid, a single strut 14 is connected to the junction of a longitudinal chord member and a lateral chord member, and at the other peripheral junctions of longitudinal and lateral chord members in the upper grid, two diagonal strut members 14 have their ends secured. In each of these junctions, four of the bolts 19 are used, any suitable washers or like spacers (not shown) being used if desired where no strut is interposed between the chord members.

Chord members of other than the channel section illustrated may be used, for example chord members of "top-hat" section, or angle members; and angle-iron members, for example, may be used for the diagonal struts, their ends being appropriately shaped for interposition and bolting between crossing chord members.

Figure 3:
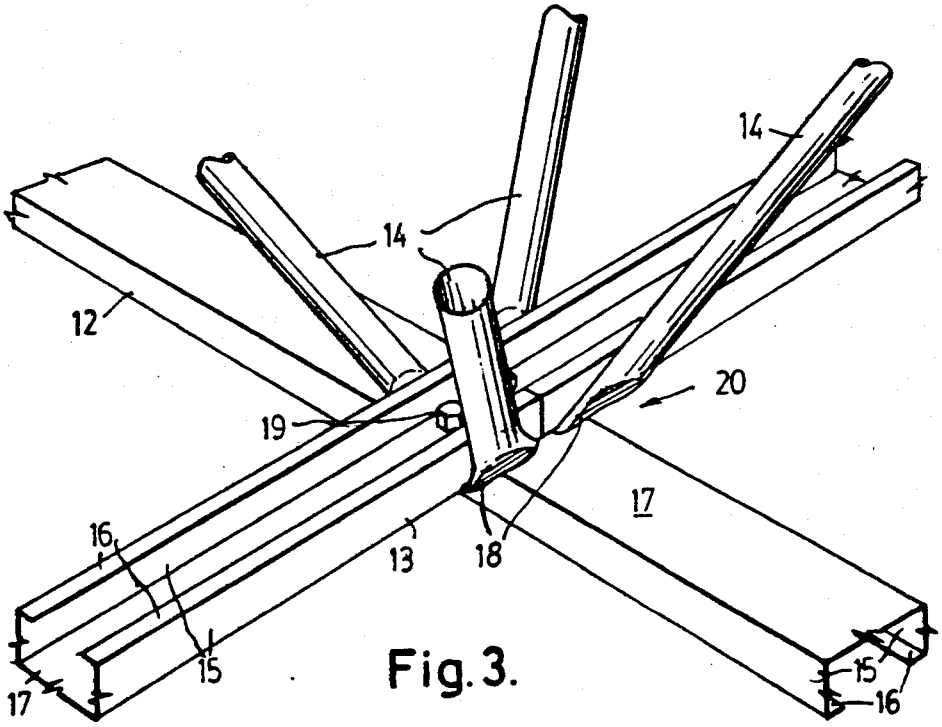
FIG. 3 is a perspective view of part of the space frame encircled at 3 in FIG. 1.

A chord member may consist of two co-joined parts, as shown in FIGS. 3 and 4, where the lateral chord member 13 is composed of two parts joined at the node in correct lineal alignment, each of the two parts being secured to the longitudinal chord member 12 by two of the bolts 19.

I claim:

1. A space frame of the type having an upper grid of longitudinal chord members and lateral chord members, a lower grid of longitudinal chord members and lateral chord members, and diagonal struts interconnecting nodes at chord intersections of the two grids, characterized in that at each node;

(a) one chord member of each grid overlies the other chord member of such grid, (b) an end of each strut extends from the node and is interposed between the said chord members of each grid, (c) the strut ends are in adjacent, non-superimposed, relationship, and (d) each one of the said strut ends is individually secured by a connector member passing through the said strut end and through the adjacent chord members above and below said strut end.

2. A space frame according to claim 1 and further characterized in that the longitudinal chord members and lateral chord members of each grid are channel sections having webs, said sections being oppositely arranged so that said webs face each other.

3. A space frame according to claim 1, and further characterized in that each of the diagonal struts is a tube with its opposite ends flattened, said flattened ends being substantially parallel and being bent in opposite directions through similar angles.

4. A space frame according to claim 1 wherein each of the said strut ends is formed with mitred side edges, with side edges of adjacent strut ends abutting to prevent turning of the struts about the connector members.

* * * * *